US007273366B1

(12) United States Patent
Sujata

(10) Patent No.: US 7,273,366 B1
(45) **Date of Patent: *Sep. 25, 2007**

(54) METHOD AND APPARATUS FOR DESTRUCTION OF VAPORS AND WASTE STREAMS

(75) Inventor: Mark L. Sujata, Oak Park, CA (US)

(73) Assignee: Soil-Therm Equipment, Inc., Agoura Hills, CA (US)

( * ) Notice: Subject to any disclaimer, the term of this patent is extended or adjusted under 35 U.S.C. 154(b) by 67 days.

This patent is subject to a terminal disclaimer.

(21) Appl. No.: 10/977,187

(22) Filed: Oct. 28, 2004

Related U.S. Application Data

(60) Provisional application No. 60/514,618, filed on Oct. 28, 2003.

(51) Int. Cl.
*F23G 7/06* (2006.01)
*F23D 14/46* (2006.01)
*F23N 3/00* (2006.01)

(52) U.S. Cl. ..... 431/5; 431/12; 431/190; 431/351; 431/353; 431/188

(58) Field of Classification Search ..... 431/190, 431/264, 202, 181, 187, 258, 354, 5, 8, 12, 431/353, 188, 351; 110/346, 238
See application file for complete search history.

(56) References Cited

U.S. PATENT DOCUMENTS 1,691,650 A * 11/1928 Falkenwalde ..... 239/383
4,056,068 A * 11/1977 Hafeli ..... 110/345
4,557,203 A * 12/1985 Mainord ..... 110/344
4,630,555 A * 12/1986 Guillaume et al. ..... 110/346
4,785,748 A * 11/1988 Sujata et al. ..... 110/238
4,915,038 A * 4/1990 Sujata et al. ..... 110/346
5,611,196 A * 3/1997 Wilson ..... 60/39.11
6,106,278 A * 8/2000 Andersson et al. ..... 431/243

FOREIGN PATENT DOCUMENTS

EP 0 076 020 A2 * 4/1983
EP 1 193 443 A2 * 4/2002

* cited by examiner

*Primary Examiner*—Josiah C. Cocks
(74) *Attorney, Agent, or Firm*—Richard S. Erbe

(57) ABSTRACT

A burner assembly for the destruction of noxious vapors and other waste streams includes an inner burner element in the form of a sudden expansion burner and an outer burner element that encircles the inner burner element and forms an annular passageway between the two elements. Waste vapors may be conducted directly into the flame of the inner burner element (direct inject) or routed through the annular passageway and preheated, for injection at the flame or beyond. The burner elements may include solid or perforated cones mounted on their exits to enhance mixing and injection of the streams. The burner assembly may be configured as in inline duct burner. A wide range of contaminants may be processed because waste streams having primarily nonflammable or combustion inhibiting constituents may be processed.

13 Claims, 5 Drawing Sheets

METHOD AND APPARATUS FOR DESTRUCTION OF VAPORS AND WASTE STREAMS

RELATED APPLICATIONS

This application claims the benefit of United States Provisional Patent Application No. 60/514,618, filed October 28, 2003, incorporated herein by reference.

BACKGROUND OF THE INVENTION

1. Field of the Invention

The present invention relates to waste destruction and emissions control systems. More particularly, it relates to a method and apparatus for the direct flame and/or secondary flame processing for the destruction of noxious pollutants and contaminants from a wide range of sources, including, but not limited to, waste streams from industrial processes, chemical processing, engine exhausts, and environmental cleanup operations.

2. General Background and State of the Art

Vapor and liquid streams containing hydrocarbons, contaminants, chlorinated compounds, toxics, and other volatile and nonvolatile materials represent a serious challenge to human and animal health, and to the environment in general. Over the last several years, concerted efforts have been made to dispose of such materials in a safe manner, in many cases by dumping them in fill zones. In other situations, certain hazardous materials are disposed of by burning them at trash dumps, in commercial furnaces, and the like. Depending on the burning parameters, such destruction frequently is time-consuming, incomplete, and produces noxious levels of undesired pollutants.

There exists a need for a means of destroying vapors and/or liquids containing hydrocarbons, contaminants, chlorinated compounds, toxics, and other volatile and nonvolatile materials that are removed or are the result of various environmental cleanup, engine exhaust, industrial processes, and any other remediation actions.

More specifically, there exists a need for a device and method that enables the destruction of hydrocarbon emissions and other contaminants that have elevated concentrations of the aforementioned contaminants, which may be difficult to destroy or are resistant to oxidation by 'direct flame' processing due to their inability to sustain combustion. For example, the needed device and method could be utilized for the processing and destruction of emissions drawn from environmental cleanup operations (such as Dual-Phase Extraction and Soil-Vapor Extraction) whereby high concentrations of carbon dioxide ($CO_2$) and/or low concentrations of oxygen ($O_2$) are present.

These conditions, as well as others, inhibit 'direct flame' oxidation by snuffing out the flame propagation process by the nonflammable constituents present in the vapors to be destroyed. Erratic operation and undesirable results of the existing art (for example, U.S. Pat. Nos. 5,572,866 [Loving], 5,381,659 [Loving, et al.], and 4,785,748 [Sujata, et al.]) in the field would likely cause these processes to be ineffective at achieving effective emissions control when encountering varying flows, concentrations, and any nonflammable constituents of the process stream.

There exists a need for a device and method for the destruction of noxious vapors that achieves destruction of such vapors through direct flame destruction and/or downstream secondary flame destruction, without the secondary flame destruction process impeding the performance of the upstream primary turbulent flame process's capability of destroying the compounds.

There also exists a need for a device and method for the destruction of noxious vapors whereby such vapors may be manually or automatically directed for direct flame or secondary flame destruction of the vapors, so that the method can be optimized to provide a means to destroy the vapors either by a combination of direct flame and/or downstream catalytic operation, and/or secondary flame processing, even for the application where the vapors could or are likely to extinguish the flame.

There further exists a need for the integration of turbulent combustion technologies (as found in the '748, '659, and '866 patents previously cited) with a method that directs the flame process into maximizing contact with the vapors for either preheating, partial oxidation, or compete oxidation as required by the individual process requirements and goals, or as directed by air pollution regulations and agencies. The integration of splitting the vapor flows in a co-current manner through (1) the direct flame zone, and (2) a secondary flame zone by forcing the vapors through desirable avenues such as cones, perforated cones, nozzles, or tubes enables much greater operating flexibility in achieving the desired effect of mixing and thereby achieving greater levels of destruction of noxious vapors for environmental cleanup and industrial applications.

There also exists a need for a device and method to enable the destruction of noxious emissions and combustion products that are found in diesel and Otto cycle engine processes that have elevated emissions levels of carbon dioxide and carbon monoxide, low oxygen levels, and noxious unburned or partially burned hydrocarbons. Such a process would enable either manual or automatic processing of these vapors through either direct flame or secondary downstream flame destruction without impeding the continuous operation of the burner from flameouts that are likely to occur due to the characteristics of the influent noxious combustion products.

There also exists a need for a device and method for the destruction of noxious vapors that is simple, easy to maintain, and able to process varying flows as required for the continuous operation for destruction of varying compound concentrations.

There also exists a need for a device and method for the destruction of emissions contained in the exhaust ducting of an engine, smoke stack, chimney, etc., where the soot or noxious emissions pass directly or indirectly through the flame of a burner assembly mounted in the exhaust ducting, smoke stack, chimney or the like to reduce or destroy the emissions.

SUMMARY OF THE INVENTION

The device and method of the present invention satisfy all of the foregoing needs. The device and method of the present invention virtually completely eliminates vapors contaminated with a wide variety of toxic compounds, as is required for environmental cleanup and air pollution control applications. It has been determined that through use of the present invention, environmental cleanups would be greatly benefited by the processing of the toxic or hydrocarbon contaminants through the burner system of the present invention in a wide range of flow configurations.

An additional benefit of the present invention is that the operator of the burner system of the present invention will be able to process a wide range of compounds, at varying flows, concentrations, and temperatures. The burner system of the present invention also allows the processing of vapors containing low oxygen levels or noncombustible contaminants, such as carbon dioxide, chlorinated hydrocarbons having either short or long-chained organic structures, or other substances that may require downstream destruction.

The need may exist to destroy these types of compounds through downstream catalysts and other secondary pollution control devices. The burner system of the present invention provides a preliminary step in the processing of the vapors for complete and final destruction of them. The burner system of the present invention is seen to provide a more effective means of preheating the contaminant laden vapor stream with a more cost-effective, energy efficient and reliable operating burner system that prevents mishaps, flameouts, and erratic operation when processing and/or preheating the vapors.

The present invention, in a broad aspect, provides a burner system constructed of high temperature alloys. Vapors for processing are blown from an upstream blower or air moving device into a duct for direct injection into the burner assembly. The duct is welded to an installation assembly that is mounted to the back of the burner system by means of a steel step plate.

The duct fits into an inner burner element that is generally cylindrical in shape with an open front end forming an inlet for receiving incoming vapors for destruction. The back open end of the inner burner element is of a larger diameter that the inlet end, thus forming the combustion zone of what is known as a 'sudden expansion burner.'

A removable fuel injection system is mounted to the inner burner element at the point where the inlet joins the combustion zone. The fuel injection system optionally has a number of fuel injector nozzles for spraying fuel into the combustion zone. The supply pipe for the fuel is mounted to and passes through the step plate. The fuel injector nozzles spray supplemental fuel (propane, natural gas, or other hydrocarbon fuels) to support the combustion and destruction of the incoming vapors. The spray pattern of the fuel injector nozzles is such that the fuel is directed into the incoming vapor stream toward the burner inlet such that recirculation zones are created, which supports the turbulent mixing and flame holding of the burner operation. Ignition of the fuel is provided by an electrical spark igniter.

An outer burner element is configured to slide over and contain the inner burner element in a configuration that forms an annular space between the two burner elements. This annular space provides a means for vapor or air to pass between the inner and outer burner elements, thus providing the operator with significant operating flexibility to optimize the burner system for the particular characteristics of the incoming vapor stream.

At the front of the burner assembly is a separate port in which bypass air or vapors can be injected from a blower so that the vapors or air can pass between the outer and inner burner elements. A connection line, with a manual or automatic flow control valve, connects the vapor duct and the ducting system between the blower and the bypass port. This allows the operator to divert some or all of the incoming vapors to the annular space to preheat the vapors and mix with the vapors or air from the blower and bypass the main combustion zone.

Thus, all of the vapors may be directly injected into the combustion zone, while the blower provides cooling air to pass between the inner and outer burner elements in the annular zone. Alternatively, contaminant vapor streams can be divided so that some is directly injected through the burner inlet, while a certain portion of the contaminant vapors are bypassed through the annular space and injected downstream of the flame, or just past the flame, into the inner burner element. Downstream injection can be enhanced through the use of mixing rings placed in the inner burner element and/or in the annular space.

For certain applications, such as when vapors contain carbon dioxide or low oxygen levels, all of the incoming vapor stream can be diverted to the bypass port and pass through the annular area. In this configuration, the air blower can be attached to the duct and directed into the inner burner element, providing combustion air. The burner flame is maintained and contaminant vapors are passed over the outside of the burner for downstream injection by means of mixing rings or tubes. Downstream injection of the vapors can be into the flame, or just after the flame, or just prior to the flame, depending on the required or desired processing of vapors.

A converging cone may be attached or affixed to the outer burner element for increasing turbulence as needed for more complete destruction of vapors. Alternatively, a cone may be attached to the end of the inner burner element when vapors are directly injected through the burner inlet. The use of either a solid or perforated cone can achieve different results, with each configuration offering enhancements to the destruction of vapors either in the combustion zone or downstream of the combustion zone.

A converging cone may be concurrently utilized on both the inner and outer burner elements to achieve enhance mixing and/or blending of the vapors for combustion. The hot burner exhaust gases pass through a perforated inner cone, which may or may not be more restricted at the downstream end in order to enhance or promote the exhaust gases to push through the perforations in the cone where vapors, exhaust gas, and flame (if designed as such) can intimately mix for flame destruction and/or partial oxidation of the hydrocarbons or chlorinated compounds present in the vapors.

The resulting mixtures of hot exhaust gases from the burner assembly of the present invention are exhausted into a refractory or ceramic lined chamber where proper temperatures are maintained for destruction of hydrocarbon compounds.

In another aspect of the invention, the burner system may be utilized as an in-line duct burner, with the burner assembly fitted to a ducting system containing exhaust having noxious vapors. In this configuration, the outer burner element is sized to fit the ducting system. Emissions are conducted to the inner burner element and the annular passageway. Alternatively, an intake plenum may be installed in the duct to conduct the emissions into the inlet of the inner burner element.

Further advantages of this invention will become more apparent from the following description of the preferred embodiments, which, taken in conjunction with the accompanying drawings, will illustrate, by way of example, the principles of the invention.

BRIEF DESCRIPTION OF THE DRAWINGS

The foregoing and other objects, aspects and advantages will be better understood from the following detailed description of the preferred embodiments of the invention with reference to the drawings in which.

DETAILED DESCRIPTION OF THE PREFERRED EMBODIMENTS OF THE INVENTION

In the following description of the invention, reference is made to the accompanying drawings, which form a part thereof, and in which are shown, by way of illustration, exemplary embodiments illustrating the principles of the present invention and how it may be practiced. It is to be understood that other embodiments may be utilized to practice the present invention, and structural and functional changes may be made thereto without departing from the scope of the present invention.

Figure 1:
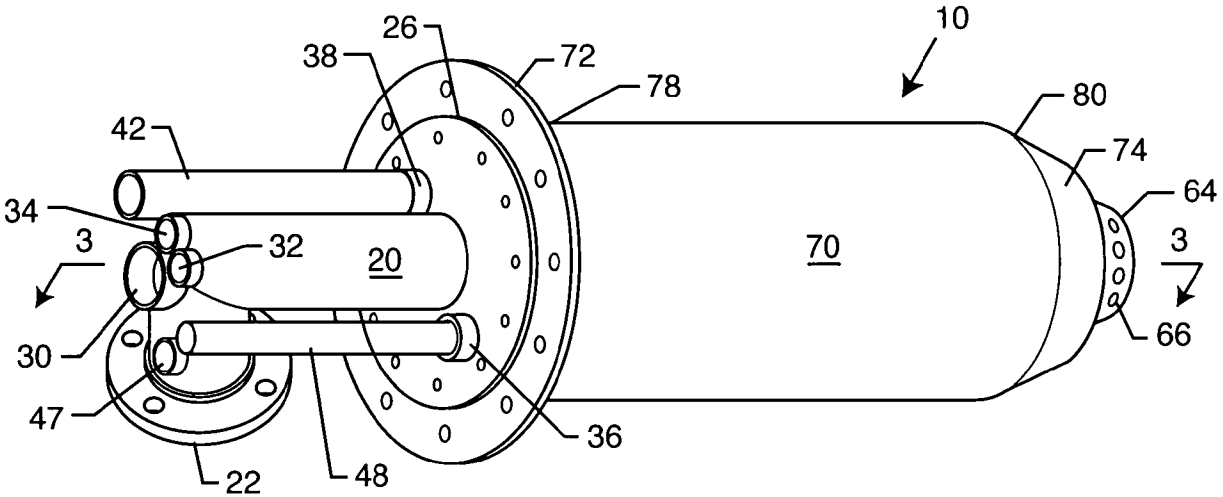
FIG. 1 illustrates a perspective view of an exemplary burner assembly according to the present invention.
Figure 2:
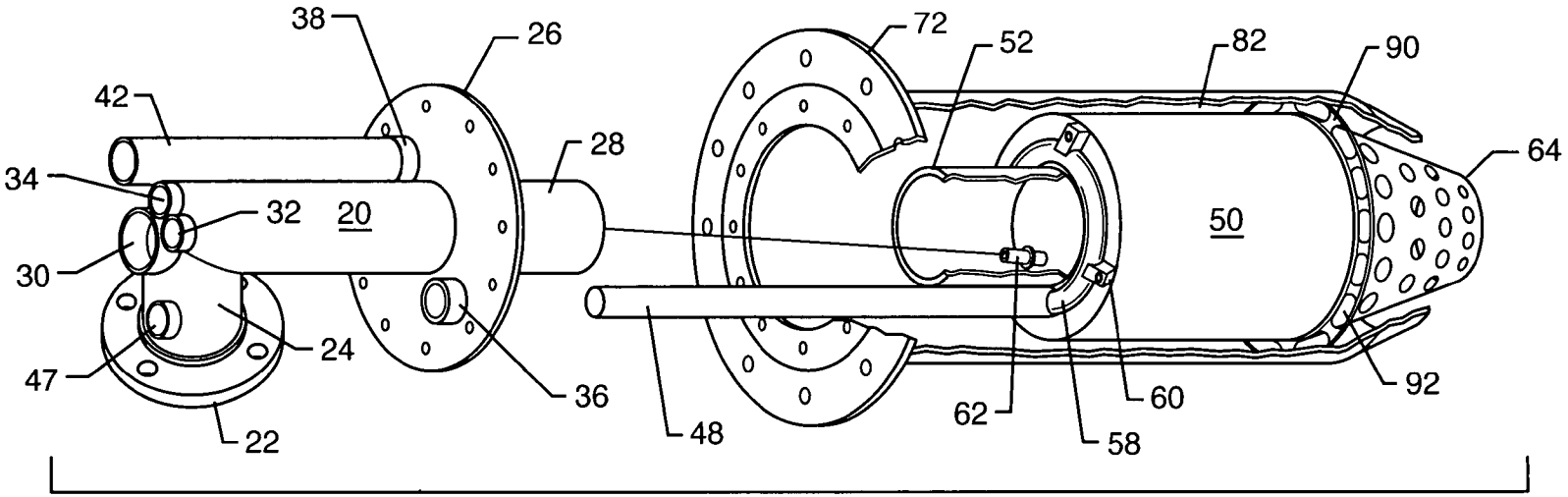
FIG. 2 illustrates an exploded perspective and partial sectional view of an exemplary burner assembly according to the present invention.
Figure 3:
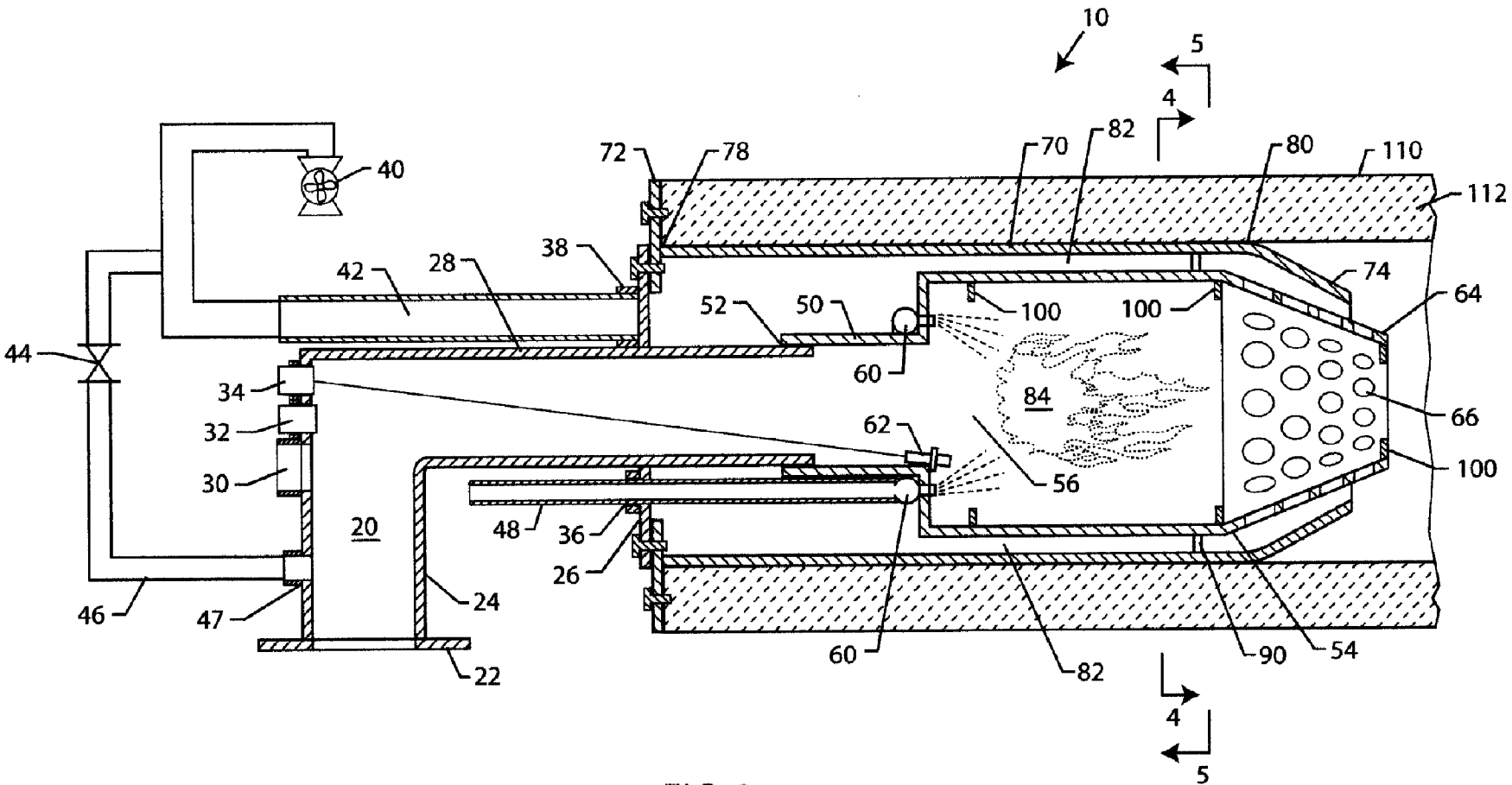
FIG. 3 illustrates a sectional side view of an exemplary burner assembly according to the present invention mounted within a thermally-lined chamber.

The preferred embodiment of a burner assembly according to the present invention is illustrated in FIGS. 1, 2 and 3, and is generally referred to by the reference numeral 10. Burner assembly 10 is generally configured of a generally tubular inner burner element 50, which fits into a generally tubular outer burner element 70. The products of combustion and exhaust gases from burner assembly 10 are directed into a thermally-lined chamber 110, which includes thermal lining 112, which may be refractory are ceramic wool, where proper temperatures are maintained for the destruction of hydrocarbons.

Inner burner element 50 includes a front inlet 52 for receiving vapors and waste streams for direct flame destruction. Inner burner element 50 is what is commonly known as a "sudden expansion burner", because the inlet 52 is of a smaller diameter than back end 54. The change in diameters from inlet 52 to back end 54 creates a very turbulent zone, which enhances mixing of combustibles and fuels and forms combustion zone 56.

Inner burner element 50 includes a supplemental fuel distribution header 58 to provide fuel to supplemental fuel nozzles 60 located adjacent combustion zone 54. Supplemental fuel, which may be methane, propane, or other hydrocarbons, is sprayed into the combustion zone 56 and ignited by a spark from spark igniter 62. The mixing of the ignited supplemental fuel with the incoming vapors or waste stream caused by the configuration of the sudden expansion burner provides for more complete destruction of the pollutants and contaminants introduced to burner assembly 10.

Outer burner element 70 surrounds inner burner element 50. The front end 78 and the back end 80 of outer burner element 70 are of the same diameter. Front end 78 includes mounting flange 72, where the components of burner assembly 10 are attached to one another.

Outer burner element 70 is spaced apart from inner burner element 50. The space in between the two forms annular passageway 82, where waste streams, vapors, and/or ambient air can be caused to flow for cooling or preheating and injection into combustion zone 56 or downstream from the combustion zone into the products of combustion.

Figure 6:
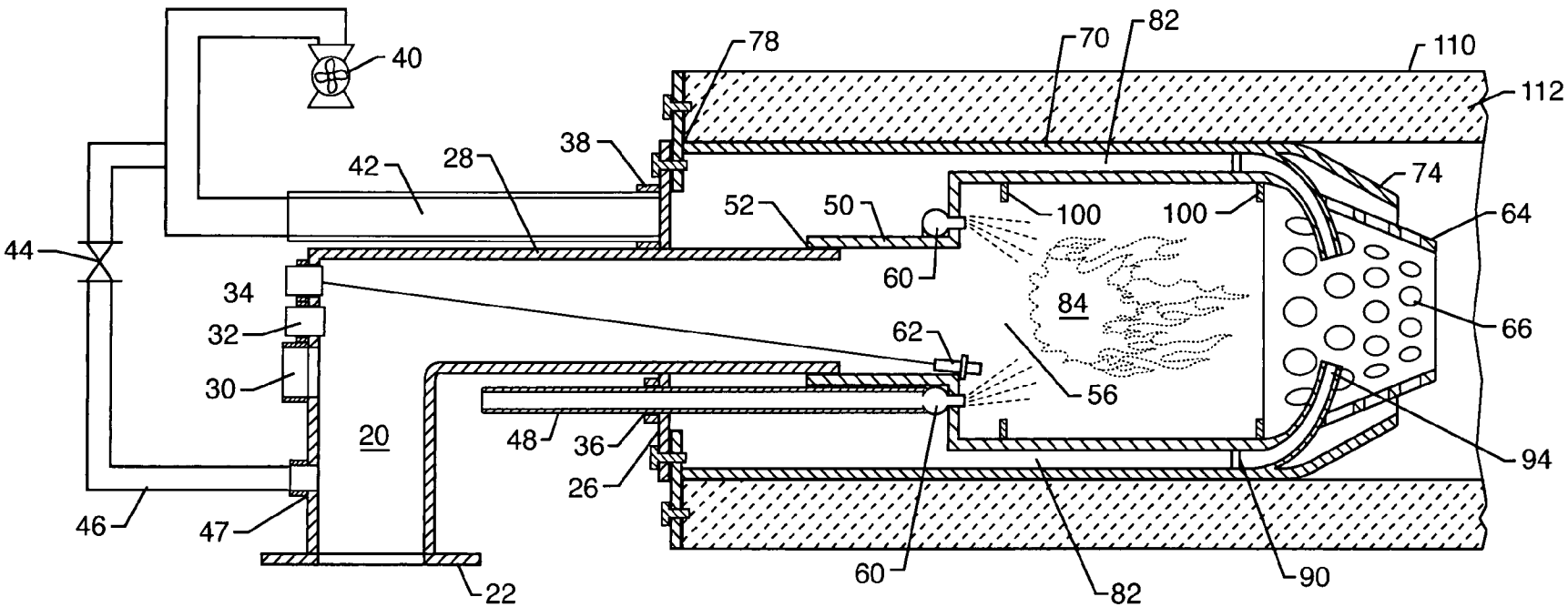
FIG. 6 illustrates sectional side view of an exemplary burner assembly according to the present invention showing tubes for injecting the bypass stream into the burner assembly.
Figure 7:
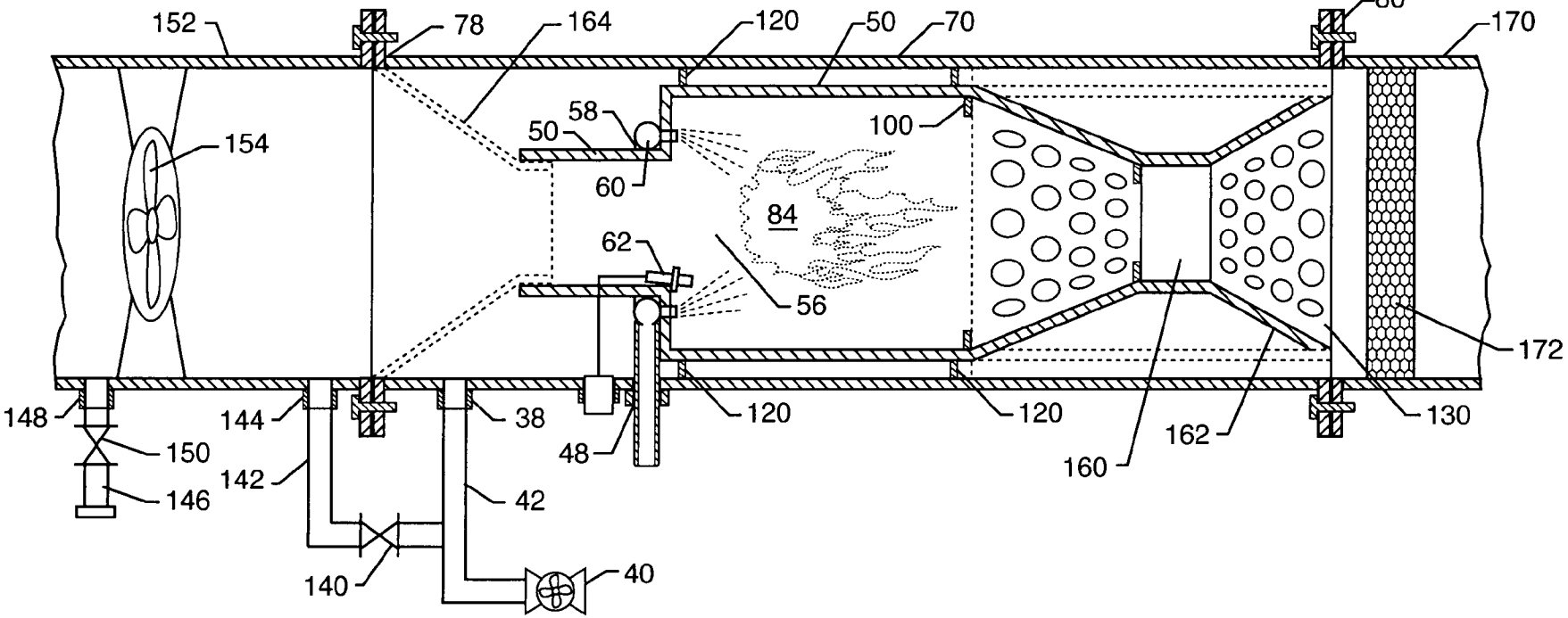
FIG. 7 illustrates an alternative embodiment of an exemplary burner assembly according to the present invention showing the burner assembly utilized as an in-line duct burner.

Waste streams and vapors are conducted into burner assembly 10 by means of influent assembly 20. Influent assembly 20 includes entrance port 22, entrance portion 24 and exit portion 28, which slides into inlet 52 for direct injection into combustion zone 54. Entrance portion 24 is attached to plate 26, which is attached to flange 72 on outer burner element 70. Plate 26 is the demarcation point between entrance portion 24 and exit portion 28 of influent assembly 20. Entrance portion 24 may be in a variety of shapes, including having an elbow, as illustrated in FIGS. 1, 2, and 6, angled, or straight, as illustrated in FIG. 7.

Entrance portion 24 and plate 26 include ports and connection points for some of the other elements of burner assembly 10. Sight port 30 in entrance portion 24 enables the operator to view the conditions inside inner burner element 50 and may also be used for direct injection of combustion air where the influent stream contains primarily noncombustible or combustion-inhibiting contaminants, such as a low oxygen and/or high carbon dioxide waste stream.

UV/flame detector port 32 in entrance portion 24 allows the operator to monitor the condition of the flame in combustion zone 56. Entrance portion 24 also serves as the attachment point for spark igniter port 34 for connecting the required electrical circuitry for operation of spark igniter 62.

Supplemental fuel is provided to supplemental fuel nozzles 60 by fuel supply line 48, which enters burner assembly 10 through supplemental fuel port 36 located on plate 26. Cooling air/bypass port 38 is also located in plate 26 and provides an entry into annular passageway 82. Cooling air to cooling air/bypass port 38 is provided by fan 40 and is conducted through supply duct 42 to cooling air/bypass port 38.

It may be desirable, depending on the nature of the influents to burner system 10 to bypass some or all of the influent through annular passageway 82 for purposes of preheating the influent stream. A bypass line 46 connects to influent assembly 20 at bypass connection port 47 to air supply duct 42 to allow influents to be diverted, either in whole or in part, away from the direct injection operation and provide cooling of the burner system 10 or preheating of the influents by passing the influents through annular passageway 82. Control of influents passing through bypass line 46 is by means of control valve 44, which may be manually or automatically controlled. Influents passing through bypass line 46 may be mixed with air from cooling fan 40 prior to being injected into annular passageway 82 through cooling air/bypass port 38.

Several optional components may be utilized in conjunction with burner assembly 10 to customize and enhance the performance of destruction operations. FIGS. 1-4 illustrate outer mixing cone 64 and inner mixing cone 74, which are optional for use with burner system 10.

It has been found that the addition of vapors, especially those having high concentrations of carbon dioxide and/or low levels of oxygen and/or various levels of difficult to burn hydrocarbons and toxic, can be injected into combustion zone 56 or mixed with the products of combustion after passing through annular passageway 82 for cooling. By attaching outer mixing cone 74 to back end 80 of outer burner element 70, complete turbulent mixing of the vapors with gases in combustion zone 56 or those gases exiting inner burner element 50 is enabled. Outer mixing cone 74 may be solid or contain openings 76, which may be in the form of round holes or slots.

Depending on the destruction efficiencies and toxic compounds requiring destruction, an optional inner mixing cone 64 may be attached or removed to back end 54 of inner burner element 50 as needed. Inner mixing cone 64 enables higher mixing and stronger flame holding characteristics to resist flameouts that may occur during operation under varying concentrations and flow rates of influents, and when encountering lower levels of inert atmospheric gases and chlorinated compounds. Destruction of these compounds may be greatly increased through the use of inner mixing cone 64, which may be solid or have openings 66 to allow the escape of hot exhaust along the length of inner mixing cone 64. Inner mixing cone 64 may be completely constricted or restricted to various size openings at the downstream end, as needed.

Figure 4:
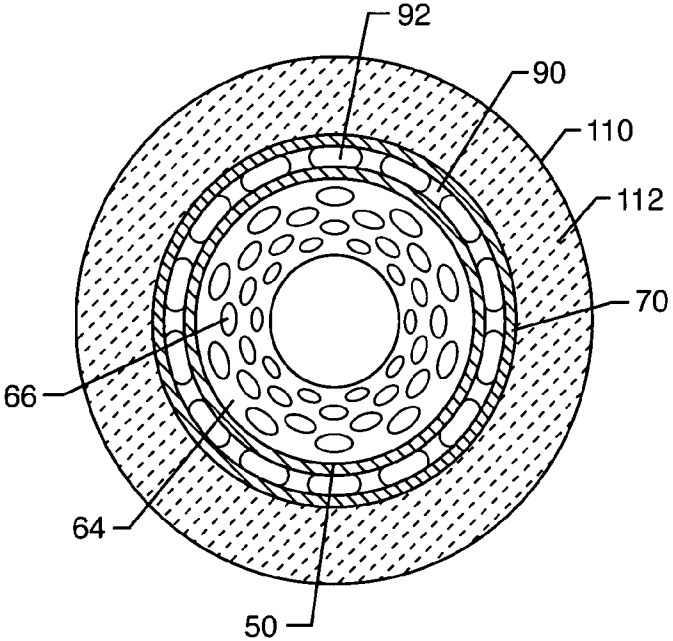
FIG. 4 illustrates a sectional view taken at line 4-4 in FIG. 3.

FIG. 4 illustrates a view of outer mixing ring 90, which is disposed in annular passageway 82. Outer mixing ring 90 includes openings 92 and enhances the ability to direct vapors into the burner assembly 10 flame or post-flame regions. Outer mixing ring 90 creates turbulence to enhance the mixing of vapors flowing through annular passageway 82 with hot gases.

FIG. 6 illustrates the use of directing tubes 94 that can provide more precise direction of vapors passing through annular passageway 82 in conjunction with outer mixing ring 90 and openings 92, in a manner such that vapors are directed to precise locations in and around inner mixing cone 64. In this manner, vapors (or vaporized liquid) may be passed through the perforations 66 into inner mixing cone 64 through directly tubes 94 for better flame involvement in inner burner element 50 where flame 84 is present.

Figure 5:
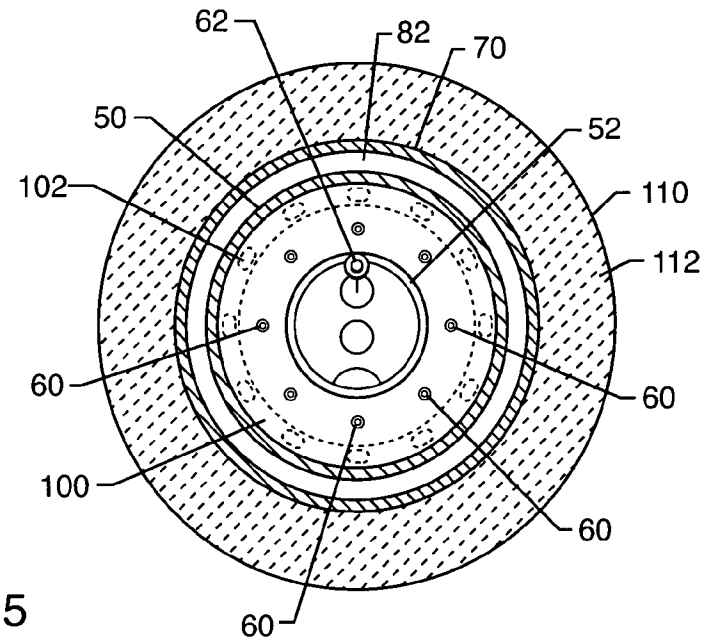
FIG. 5 illustrates a sectional view taken at line 5-5 in FIG. 3.

FIG. 5 illustrates a view of inner mixing ring 100, which is disposed in inner burner element 50 within, near or downstream of combustion zone 56 to enhance the mixing of fuel, vapor, and flame. Inner mixing ring 100 may include openings or perforations 102. One or more inner mixing rings may be utilized, depending on the particular application and the desired effect.

The burner system of the present invention may be operated in a variety of configurations to optimize operations to particular kinds of vapors and waste streams. All of the incoming vapors can pass directly from influent assembly 20 into inlet 52 in inner burner assembly 50. Cooling air from cooling fan 40 may be passed through cooling air/bypass port 38 into annular passageway 82 for cooling purposes. In this configuration, control valve 44 controlling vapors to bypass line 46 is closed. High destruction of vapors occurs at 1400° F., and with the use of downstream catalysts, effective preheating of the vapors is achieved prior to the catalyst.

In another configuration of burner system 10, contaminant vapors can pass both through inlet 52 ('direct injection') and annular passageway 82 for passing concurrently through the annular passageway and injected downstream into or just past flame 84. Downstream injection can be through the use of inner mixing ring 100 or outer mixing ring 90, whichever is deemed beneficial for the destruction of vapors. In this configuration, some of the vapors entering influent assembly 20 will be diverted and flow through bypass line 46 by operation of control valve 44 and into annular passageway 82 through cooling fan duct 42 and cooling air/bypass port 38.

Another way of configuring burner assembly 10 is to route the incoming vapor stream directly to cooling air/bypass port 38. In this configuration, entrance port 22 is sealed off. The sight glass from sight glass port 30 is removed and cooling air from cooling air fan 40 is routed through sight glass port 30 directly to the inlet 52. In this configuration, vapors are preheated as they pass over inner burner element 50 through annular bypass 82. Combustion is supported by the air from cooling air fan 40. Flame 84 is maintained and contaminant vapors and injected downstream by the use of openings 102 in outer mixing ring 90. Downstream injection of vapors can be into flame 84, just before flame 84, depending on the required or desired processing of vapors. This configuration is especially applicable when the influent vapors are high in carbon dioxide and/or low in oxygen, which inhibits combustion. Inner mixing cone 64 may be attached to back end 54 as needed for more complete destruction and/or turbulence for destruction of vapors.

FIG. 7 illustrates an alternative embodiment of the present invention in the form of an inline duct burner for inline destruction of emissions. Applications for this embodiment of the invention may include paint fumes, smoke from industrial processes, restaurants, fireplaces, automotive exhaust, diesel engine exhaust, etc. This embodiment of the present invention may be made in a variety of sizes, depending on the desired application and the size of the ducting through which the emissions are flowing.

In this alternative embodiment of the invention, inner burner element 50 is placed within outer burner element 70, which is configured with the same dimensions as the duct 152 through which the emissions are flowing. Front end 78 of outer burner element 70 connects to duct 152, while back end 80 may be open or connected to outlet duct 170, which may contain catalyst 172 for post-combustion treatment of the emissions. A series of spacers 120 are connected to the outer wall of inner burner element 50 to stabilize inner burner element 50 within outer burner element 70. The positioning of inner burner element 50 within outer burner element 70 forms annular passageway 82, through which may pass some of the emissions and/or supplemental air. Cooling air to cooling air/bypass port 38 is provided by fan 40 and is conducted through supply duct 42 to cooling air/bypass port 38.

An optional intake plenum 164 may be included in the alternative embodiment of the invention to direct emissions into inlet 52 and provide another means of securing inner burner element 50 to outer burner element 70. Supplemental air can also be provided by blower 40 through duct 142 to connection 144 in duct 152, as well as through duct 42 to connection port 38. Flow control valve 140 can be used to adjust the various flow rates.

Optional induced draft fan 154 can be used to draw emissions through duct 152 and also to draw ambient air through duct 146 and port 148 on duct 152. Control valve 150 can be used to adjust the flow of air coming through port 148.

Inner burner element 50 may also include inner mixing ring 100 to increase turbulence to enhance the destruction process. The inner mixing ring may be located in a variety of positions, such as adjacent combustion zone 56, just after flame 84, or at back end 54. Other aspects of this alternative embodiment of the invention include a converging inner mixing cone 64, which can be solid or perforated, attached to back end 54. A straight section 160 and a diverging exit cone 162 may also be attached to back end 54 or to the end of inner mixing cone 64.

The foregoing description of the exemplary embodiments of the present invention have been presented for purposes of enablement, illustration, and description. It is not intended to be exhaustive of or to limit the present invention to the precise form discussed. There are, however, other configurations for burner systems not specifically described herein, but with which the present invention is applicable. The present invention should therefore not be seen as limited to the particular embodiment described herein; rather, it should be understood that the present invention has wide applicability with respect to burner systems. Such other configurations can be achieved by those skilled in the art in view of the description herein. Accordingly, the scope of the invention is defined by the following claims.

What is claimed is:

1. A burner system producing a flame for destruction of vapors comprising:

a generally elongated outer burner element having a sidewall, a front end having an opening, an opposed open back end, and a flange mounted to said front end;

a generally tubular elongated inner burner element disposed within and spaced inwardly from said outer burner element, said inner burner element being open at opposed front and back ends thereof, including a small diameter front inlet and a larger diameter combustion zone at said back end;

a vapor duct assembly connected to said front inlet, said vapor duct assembly including a duct portion, an elbow, and a step plate attached to said duct portion and said flange;

an annular passageway formed between the inner burner element and the outer burner element for bypassing cooling air past and around the flame;

a spark igniter connected to said vapor duct assembly and passing through said elbow and said front inlet and into said combustion zone;

at least one fuel ignition device mounted to said inner burner assembly at said combustion zone;

a bypass opening connected to said step plate in fluid connection with said annular passageway;

an air blower located adjacent the front end of the outer burner system;

an air supply duct connected between said air blower and said bypass opening said annular passageway;

a bypass line between said duct portion and said air supply duct; and a control valve mounted on said bypass line to control the flow of vapors between the elbow and the air supply duct, whereby, the volume of the flow of vapors to the combustion zone may be controlled and varied to optimize burner performance.

2. The burner system according to claim 1, further comprising an outer mixing ring disposed in said annular passageway, said ring having a plurality of openings therein.

3. The burner system according to claim 1, further comprising an inner mixing ring disposed within said inner burner element.

4. The burner system according to claim 1, further comprising:

a converging inner mixing cone connected to the back end of said inner burner element; and an outer mixing cone connected to the back end of said outer burner element, whereby, vapors may be injected downstream of the combustion zone to mix with gases exiting the combustion zone.

5. The burner system according to claim 4, further comprising a plurality of openings in said inner mixing cone.

6. The burner system according to claim 4, further comprising a plurality of openings in said outer mixing cone.

7. The burner system according to claim 1, further comprising a combustion air opening in said vapor duct assembly.

8. The burner system according to claim 2, further comprising a plurality of injection tubes extending from said openings in said outer mixing ring to direct flow in said annular passageway into hot gases exiting from the inner burner element.

9. A method for the destruction of waste vapors comprising the steps of:

providing an elongated chamber having a sidewall, a front end with an opening, and an opposite open back end;

providing a sudden expansion burner disposed within said chamber forming an annular passageway between said burner and said chamber, the burner having a relatively small diameter vapor inlet, an inlet vapor duct, a relatively larger diameter, elongated combustion zone, and at least one fuel nozzle extending into said combustion zone;

providing an air blower located adjacent the front end of the elongated chamber and an air supply duct to direct air from the air blower to the annular passageway;

injecting air into said annular passageway;

providing a bypass duct between the inlet vapor duct and the air supply duct with a flow control valve to adjust the volume of vapors flowing to the burner inlet and the annular passageway;

injecting a portion of said waste vapors into said combustion zone;

mixing a portion of said waste vapors with the air in said annular passageway to form a waste vapor/air mixture;

injecting fuel from said fuel nozzle into said combustion zone;

igniting the vapors and the fuel in the combustion zone and injecting the vapor/air mixture downstream of said combustion zone, whereby, the vapor/air mixture is ignited by gases exiting the combustion zone, and whereby, the ratio of the vapor to air in the annular passageway may be varied by operation of the control valve.

10. The method according to claim 9, further comprising the steps of:

restricting the flow of air and vapors in the annular passageway; and restricting the flow of vapors and combustion products in said combustion zone.

11. A method for the destruction of waste vapors having high carbon dioxide and low oxygen content comprising the steps of:

providing an elongated chamber having a sidewall, a front end with an opening, and an opposite open back end and an outer mixing cone at said back end;

providing a sudden expansion burner having a front end and a back end disposed within said chamber forming an annular passageway between said burner and said chamber, said burner having a relatively small diameter inlet at said front end, a relatively larger diameter, elongated combustion zone, an inner mixing cone at said back end, an inlet vapor duct having an inlet port for said waste vapors, an opening on the inlet vapor duct in which to mount a sight glass, and at least one fuel nozzle extending into said chamber;

providing an air blower located adjacent the front end of the elongated chamber and an air supply duct to direct air from the blower to the annular passageway;

providing a bypass duct between the vapor inlet and the air supply duct and a flow control valve mounted on the bypass duct to control the flow of vapors between the vapor inlet and the air supply duct;

injecting fuel from said fuel nozzle into said combustion zone;

igniting the air and the fuel in the combustion zone to produce a flame and heat; and injecting the waste vapors/air mixture from the annular passageway around and between the inner mixing cone and the outer mixing cone downstream of the combustion zone.

12. The method according to claim 11, further comprising the steps of:

closing off the inlet vapor duct;

opening the control valve to conduct all of the incoming waste vapors to the bypass duct and to the annular passageway;

removing the sight glass from the sight glass port; and conducting combustion air through the sight glass port to the combustion zone.

13. A method for the destruction of a waste vapor stream flowing inside a duct comprising the steps of:

providing an elongated chamber of the same shape and outer dimensions as the duct, said chamber having a sidewall, a front end with an opening, an opposite open back end, and having a converging mixing cone and a diverging mixing cone couples to said converging mixing cone at said back end;

providing a sudden expansion burner disposed within said chamber, said sudden expansion burner having a relatively small diameter inlet, a relatively larger diameter, elongated combustion zone, and at least one fuel nozzle extending into said combustion zone;

forming an annular passageway between said burner and said chamber;

providing an air blower located adjacent the front end of the elongated chamber;

providing an air supply duct connecting said air blower to said duct;

providing an air bypass duct between said air supply duct and said duct;

providing a flow control valve in said air bypass duct to enable air to be diverted to said inlet;

connecting said chamber to said duct at said back end and said front end;

conducting the waste vapor stream into said sudden expansion burner and said annular passageway;

injecting air into said sudden expansion burner and said annular passageway;

injecting fuel from said fuel nozzle into said combustion zone;

igniting the air and the fuel in the combustion zone;

injecting a portion of the waste vapor stream into said combustion zone; and injecting some of the waste vapor stream downstream of said combustion zone to mix with gases exiting the combustion zone.

* * * * *